US009112301B2

(12) United States Patent
Chang

(10) Patent No.: US 9,112,301 B2
(45) Date of Patent: Aug. 18, 2015

(54) ELECTRICAL CONNECTOR WITH PRINTED CIRCUIT BOARD

(71) Applicant: HON HAI PRECISION INDUSTRY CO., LTD., New Taipei (TW)

(72) Inventor: Shih-Tung Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 52 days.

(21) Appl. No.: 13/975,396

(22) Filed: Aug. 26, 2013

(65) Prior Publication Data

US 2014/0057465 A1 Feb. 27, 2014

(30) Foreign Application Priority Data

Aug. 24, 2012 (CN) ..... 2012 1 0304276

(51) Int. Cl.
*H01R 12/79* (2011.01)
*H01R 12/59* (2011.01)
*H01R 12/62* (2011.01)

(52) U.S. Cl.
CPC ..... *H01R 12/59* (2013.01); *H01R 12/62* (2013.01)

(58) Field of Classification Search
CPC .... H01R 12/79; H01R 12/62; H01R 13/6658; H01R 23/025
USPC ..... 439/493, 76.1
See application file for complete search history.

(56) References Cited

U.S. PATENT DOCUMENTS

| | | | | |
|---|---|---|---|---|
| 6,685,501 | B1 * | 2/2004 | Wu et al. | 439/497 |
| 7,699,646 | B2 * | 4/2010 | Zhu et al. | 439/493 |
| 7,758,374 | B2 * | 7/2010 | Yu et al. | 439/493 |
| 7,922,520 | B2 * | 4/2011 | Mizukami | 439/493 |
| 8,662,917 | B2 * | 3/2014 | Wang et al. | 439/497 |
| 2002/0039857 | A1 * | 4/2002 | Naito et al. | 439/493 |
| 2004/0157492 | A1 * | 8/2004 | Wu et al. | 439/607 |
| 2006/0270271 | A1 * | 11/2006 | Moriyama et al. | 439/499 |
| 2009/0130896 | A1 * | 5/2009 | Cheng et al. | 439/495 |
| 2009/0197459 | A1 * | 8/2009 | Yu et al. | 439/497 |
| 2009/0253292 | A1 * | 10/2009 | Wu | 439/493 |
| 2010/0062636 | A1 * | 3/2010 | Wang et al. | 439/493 |

FOREIGN PATENT DOCUMENTS

| | | |
|---|---|---|
| TW | M426904 | 4/2013 |

* cited by examiner

*Primary Examiner* — Gary Paumen
(74) *Attorney, Agent, or Firm* — Wei Te Chung; Ming Chieh Chang

(57) ABSTRACT

An electrical connector for a cable includes a PCB and a fixed element for holding the PCB. The PCB includes several first contacting fingers and second contacting fingers electrically connected to each other at different sides along a first direction. The first and second contacting fingers are respectively arranged along a second direction perpendicular to the first direction to be disposed in two rows. The second contacting fingers are connected to the cable. Wherein said PCB is longer than said fixed element so as to expose first contacting fingers at a front side of the fixed element along the first direction and form a mating port for a mating connector.

20 Claims, 4 Drawing Sheets

ELECTRICAL CONNECTOR WITH PRINTED CIRCUIT BOARD

BACKGROUND OF THE INVENTION

1. Field of the Invention

The present invention relates to an electrical connector with a PCB (printed circuit board) for connecting with an FFC (flexible flat cable) or an ordinary flat cable.

2. Description of Related Art

Taiwan Patent No. M426904 discloses an electrical connector including an FFC, a first insulating layer and a second layer lay at top and bottom of the FFC. The free end of the FFC is exposed and acts as a mating port for mating with a mating electrical connector. However, the FFC is flexible and will be easily broken during frequent use.

Hence, an electrical connector with better mechanical performance is desired.

BRIEF SUMMARY OF THE INVENTION

Accordingly, an object of the present invention is to provide an electrical connector providing better mechanical intensity.

To achieve the above object, an electrical connector for a cable includes a PCB and a fixed element for holding the PCB. The PCB includes several first contacting fingers and second contacting fingers electrically connected to each other at different sides along a first direction. Each first or second contacting finger arranged along a second direction perpendicular to the first direction. The second contacting fingers connected to the cable. Wherein said PCB is longer than said fixed element so as to expose first contacting fingers at front side of the fixed element along the first direction and form a mating port for a mating connector.

DETAILED DESCRIPTION OF THE PREFERRED EMBODIMENTS

Figure 1:
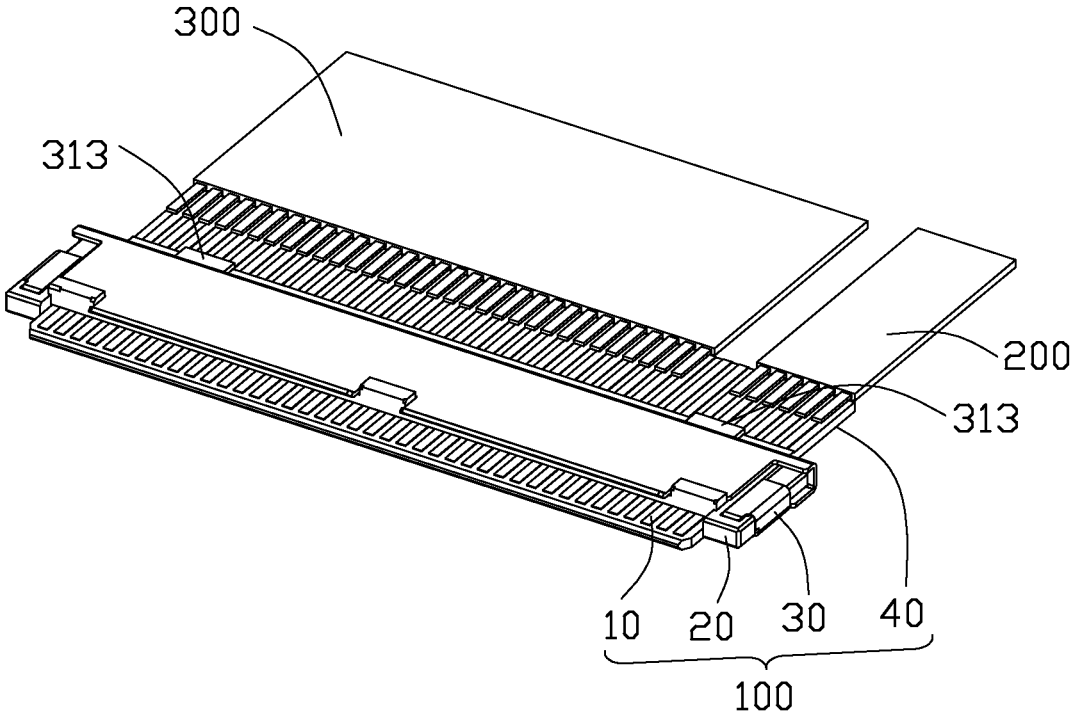
FIG. 1 is a perspective view of an electrical connector accordance with a preferred embodiment of the present invention.

Reference will now be made to the drawing figures to describe the preferred embodiment of the present invention in details. FIGS. 1~4 illustrate an electrical connector 100 for electrically connecting cables 200, 300, e.g., the FFCs, with a mating electrical connector (not shown). The electrical connector comprises a PCB 10, a fixed element 20 for holding the PCB, and a metal shell 30 shielding the PCB. In the preferred embodiment, the PCB is made of hard material so as to be strong enough to mate with the mating electrical connector.

Figure 2:
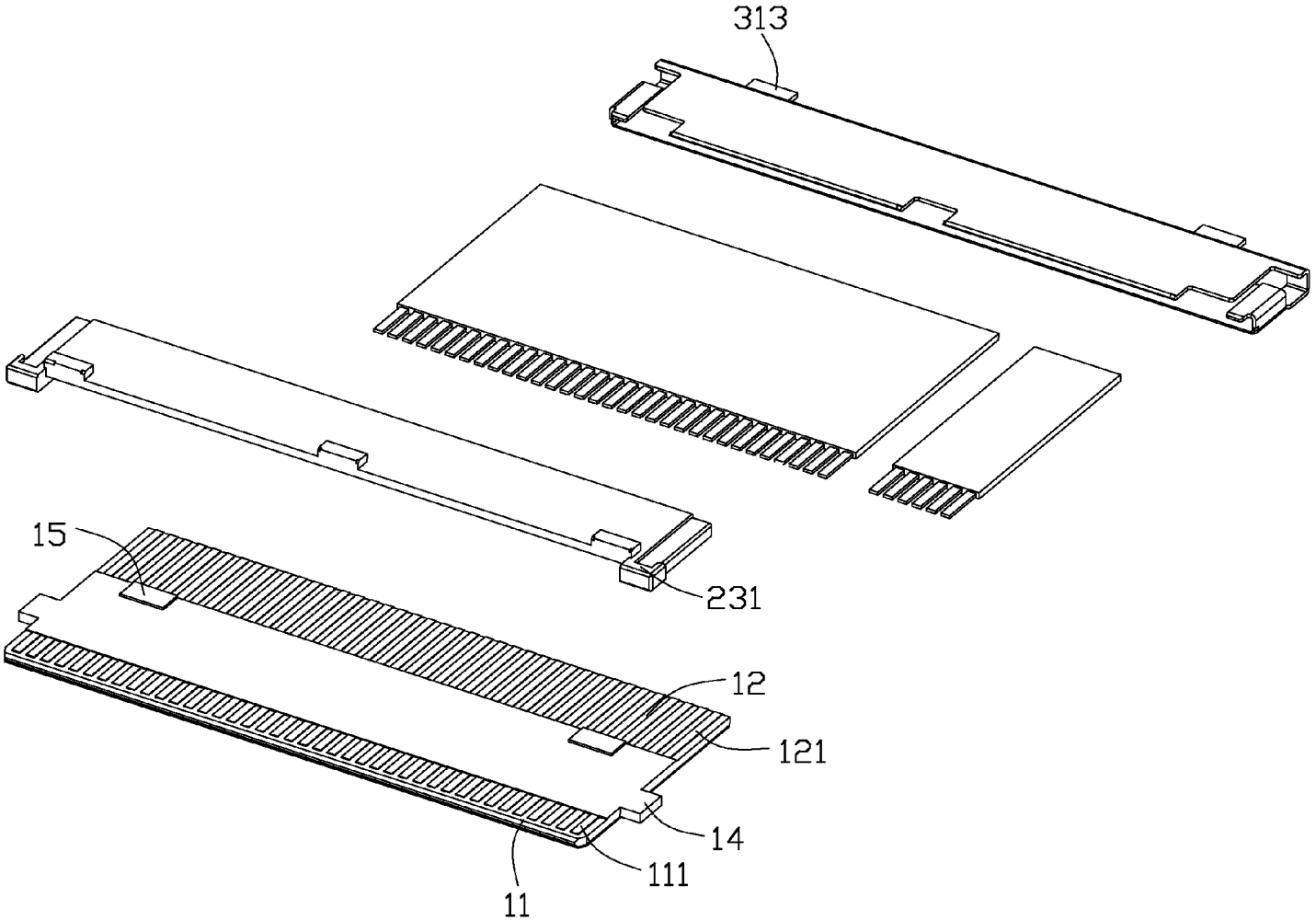
FIG. 2 is an exploded view of the electrical connector shown in FIG. 1.

Referring to FIG. 2, the PCB is in a flat shape. Said PCB defines a mating port 11 and a connecting port 12 opposite to each other along a mating direction. The mating end 11 defines several first contacting fingers 111 along a longitudinal direction perpendicular to the mating direction. The connecting end also defines several second contacting fingers 121 along the longitudinal direction. Each first contacting finger 111 is electrically connected to corresponding second contacting finger 121 by an electric path located in the PCB.

Figure 3:
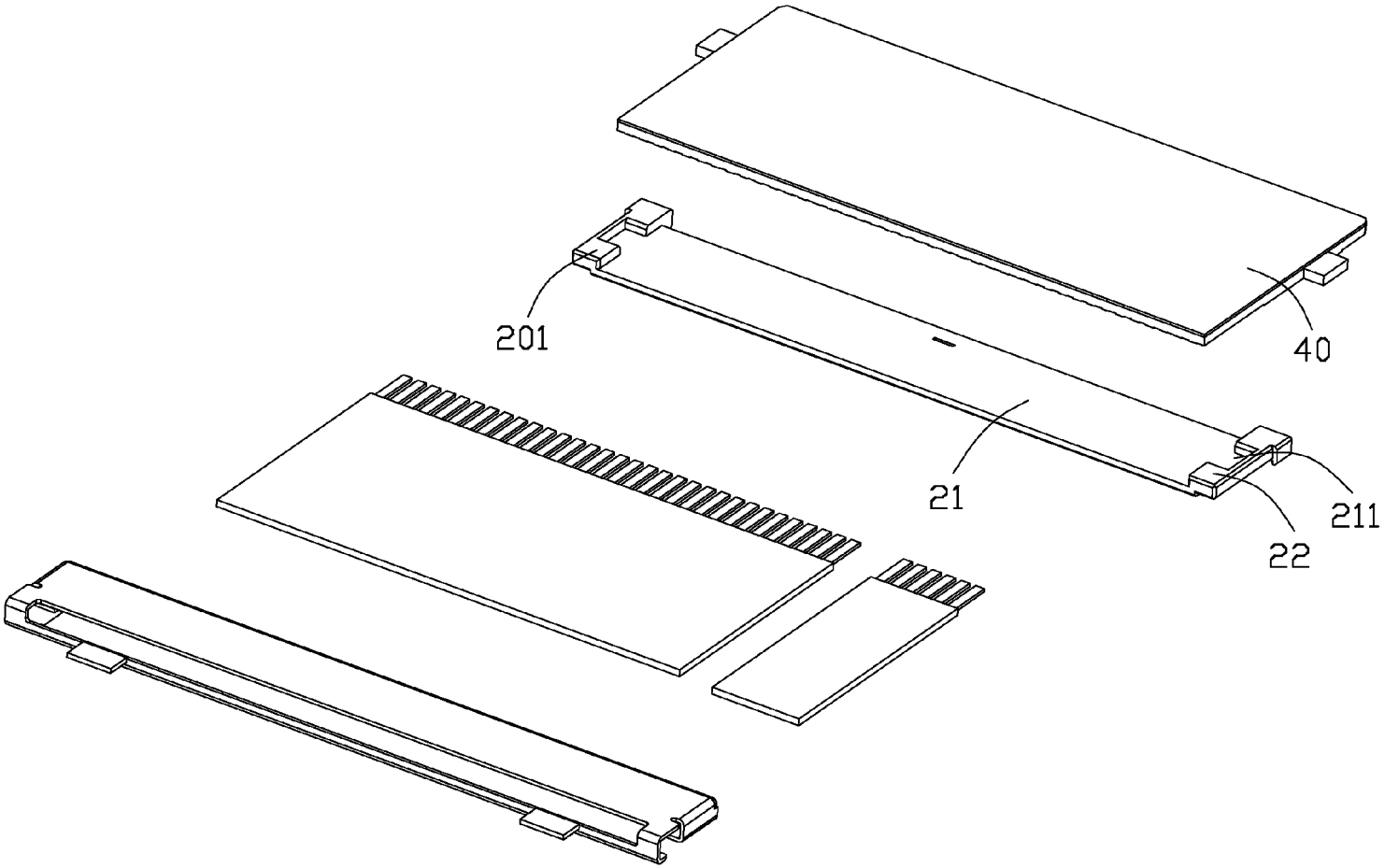
FIG. 3 is a partially exploded view of the electrical connector shown in FIG. 1.

Combination with FIG. 3, the PCB includes a pair of protruding portions 14 at two opposite sides thereof. The fixed element 20 defines a pair of recesses 211 to receive and restrict said protruding portions, which prevents the PCB from moving along the mating direction. The height of the protruding portion is accurate equal to depth of recess 211.

Figure 4:
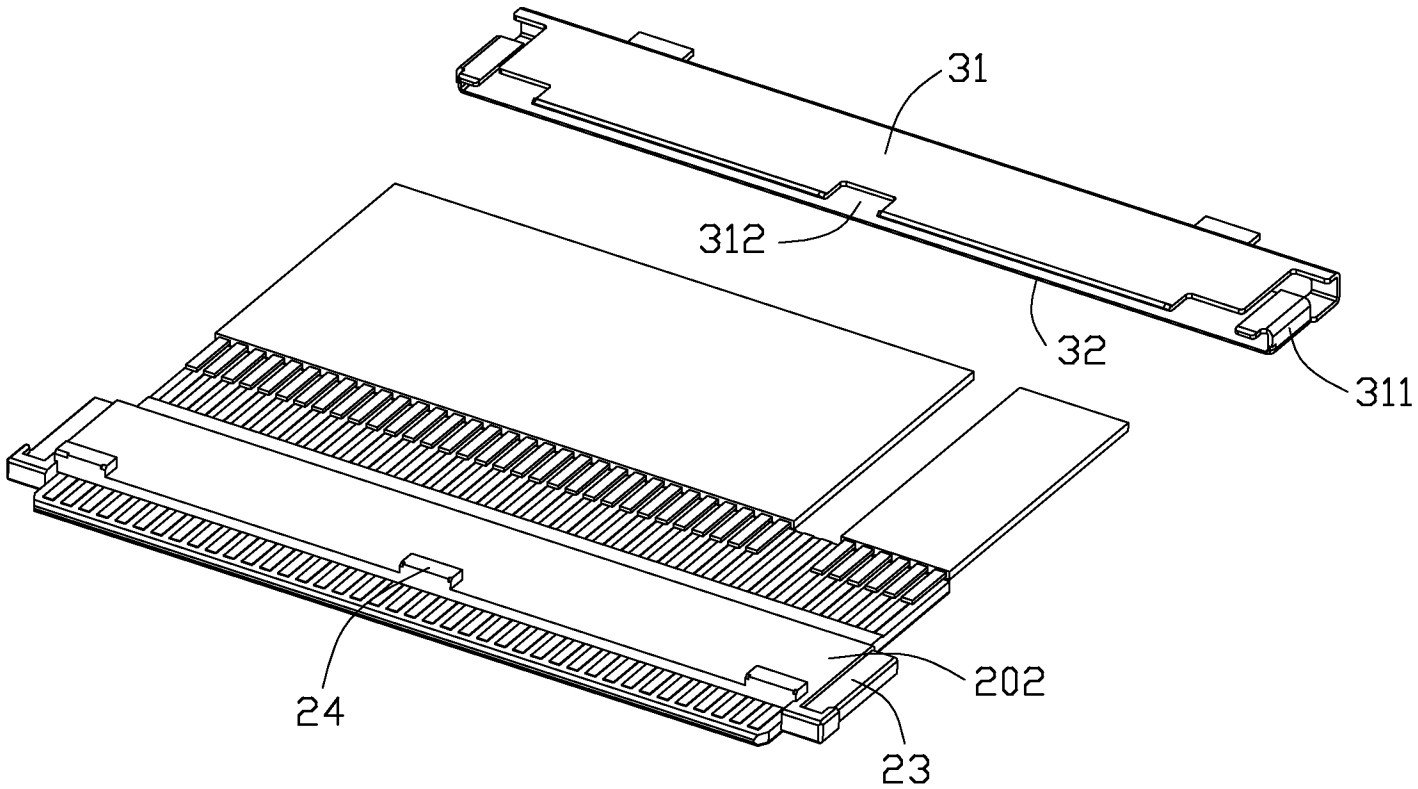
FIG. 4 is another exploded view of the electrical connector shown in FIG. 1.

Combination with FIGS. 3 and 4, the PCB is downwardly assembled to the fixed element 20 in a vertical direction, while the metal shell 30 is forwardly assembled along the mating direction. The fixed element 20 defines a mating space 21 running through its bottom face 201 and opposite front and rear ends along the mating direction. The receiving space 21 is formed between a pair of side walls 22 and communicating with the recesses 211. Each side wall 22 downwardly recesses at an outer upper surface thereof to form a guiding portion 23 for guiding the metal shell 30.

The metal shell 30 includes opposite first part 31 shielding a top surface of the PCB and second part 32 shielding a bottom surface of the PCB. The second part 32 includes two L-shaped retaining sections 311 respectively grasped opposite sides of the fixed element 20. The retaining sections 311 slides along the guiding portion 23 until being stopped by a stopping portion 231 at a front portion of the guiding portion 23. The first part 31 of the metal shell has several openings 312 arranged averagely along the longitudinal direction. The fixed element 20 has several protruding sections 24 to be received in the openings 312 so as to ensure stably assembling. The first part 31 of the metal shell further includes a pair of pressing arms 313. The PCB defines a pair of grounding fingers 15 pressed and touched by the pressing arms 313, which forming a grounding path and decreasing electromagnetic interference.

Referring to FIG. 1, the PCB 10 is longer than the fixed element 20 along the mating direction. The first contacting fingers 111 are protruding from the metal shell 30 and the fixed element 20 so as to form said mating port 11. The second contacting fingers are connected to cables 200, 300. The cables 200, 300 are flat and parallel to each other in the preferred embodiment.

In another preferred embodiment, the PCB is an FPC (flexible printed circuit). An intensive board 40 is attached at a bottom face or a top face of the FPC, even two sides of the FPC to increase rigidity especially when mating with a mating electrical connector. The intensive board 40 could be made of metal or plastics. The intensive could be attached to the FPC by injection molding or pasting.

In the PCB, the pitch between every adjacent two contacting fingers could be changed for better electric performance and a function of pin jump can be achieved so as to allow flexibility of pin arrangement at two opposite mating ends of the whole cable assembly set. In opposite, it is relatively difficult to arrange the respective wires of the traditional FFC if the wire ends are not arranged at two opposite mating ends in the same sequence. Moreover, the PCB has higher rigidity for mating with a mating connector. At the same time, the present electrical connector is also able to decrease height of the whole electric systems. In essence, the invention uses the so-called hybrid cable assembly, i.e., a relatively expensive PCB/FPC plus a relatively inexpensive FFC, to solve the differently arrangement of the wire sequence at two mating ends of the whole cable assembly under a reasonable cost. In opposite, using the pure traditional FFC has difficulties to rearrange the different sequential pin assignment at two opposite mating ends while using the pure traditional FPC is relatively too expensive disadvantageously both.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting with a cable, comprising:

a PCB, comprising several first contacting fingers and second contacting fingers electrically connected to each other at different sides along a first direction, the first and second contacting fingers respectively arranged along a second direction perpendicular to the first direction to be disposed in two rows, said second contacting fingers connected to said cable; and a fixed element for holding said PCB;

wherein said PCB is longer than said fixed element so as to expose the first contacting fingers at a front side of the fixed element along the first direction to form a mating port for mating with a mating connector;

wherein a metal shell is assembled to said fixed element along the first direction to shield said PCB.

2. The electrical connector as claimed in claim 1, wherein the metal shell defines several pressing arms contacting ground fingers set at one surface of the PCB.

3. The electrical connector as claimed in claim 1, wherein said PCB includes several protruding portions at both sides along the second direction while the fixed element includes corresponding recesses to receive the protruding portions.

4. The electrical connector as claimed in claim 1, wherein the fixed element is assembled to said PCB along a third direction perpendicular to both said first direction and second direction.

5. The electrical connector as claimed in claim 1, wherein the fixed element defines a pair of guiding portions to guide the metal shell along the first direction.

6. The electrical connector as claimed in claim 1, wherein the fixed portion at least supports one surface of the PCB and the metal shell shielding said surface and another opposite surface.

7. The electrical connector as claimed in claim 1, wherein said PCB is an FPC and an intensive board is attached to the bottom of the FPC.

8. The electrical connector as claimed in claim 7, wherein intensive board is attached to the FPC by injection molding.

9. An electrical connector assembly comprising:

a PCB (printed circuit board) defining opposite mating port and connecting port in a first direction;

a plurality of first contacting fingers located on the mating port with a first sequential arrangement along a second direction perpendicular to said first direction;

a plurality of second contacting fingers electrically connected to first contacting fingers and located on the connecting port with a second sequential arrangement along the second direction;

an FFC (flexible flat cable) with one end connecting to the connecting port; and a fixing element associated with the PCB to form a connector structure around the mating port for mating with a complementary connector; wherein the fixed element is assembled to the PCB in a third direction perpendicular to both said first direction and said second direction.

10. The electrical connector assembly as claimed in claim 9, wherein said connector structure further includes a metallic shell circumferentially securing said PCB and said fixing element.

11. The electrical connector assembly as claimed in claim 10, wherein said shell includes at least one grounding pad finger mechanically and electrically connected unto the PCB.

12. The electrical connector assembly as claimed in claim 9, wherein said first sequential arrangement is different from said second sequential arrangement.

13. The electrical connector assembly as claimed in claim 9, wherein said FFC is divided into two different units in the second direction.

14. The electrical connector assembly as claimed in claim 9, wherein said PCB is longer than the fixing element in the first direction to expose the PCB to an exterior in a third direction perpendicular to both said first direction and said second direction.

15. The electrical connector assembly as claimed in claim 9, wherein said PCB is an FPC (flexible printed circuit).

16. The electrical connector assembly as claimed in claim 9, wherein a metal shell is assembled to said fixed element along the first direction to shield said PCB.

17. An electrical connector assembly comprising:

a PCB (printed circuit board) defining opposite mating port and connecting port in a first direction;

a plurality of first contacting fingers located on the mating port with a first sequential arrangement along a second direction perpendicular to said first direction;

a plurality of second contacting fingers located on the connecting port with a second sequential arrangement along the second direction for connecting to at least one FFC (flexible flat cable); and a fixing element associated with the PCB and commonly secured within a metal shell to form a connector structure around the mating port for mating with a complementary connector; wherein the first sequential arrangement is different from the second sequential arrangement; wherein said PCB is an FPC (flexible printed circuit).

18. The electrical connector assembly as claimed in claim 17, wherein said shell defines a grounding finger electrically and mechanically connected unto the PCB.

19. The electrical connector assembly as claimed in claim 17, wherein said PCB is longer than the fixing element and said shell in the first direction to expose the PCB in a third direction perpendicular to both said first direction ands aid second direction.

20. The electrical connector assembly 17, wherein the fixed element is assembled to the PCB in a third direction perpendicular to both said first direction and said second direction.

* * * * *